US005635924A

United States Patent [19]

Tran et al.

[11] Patent Number: 5,635,924

[45] Date of Patent: Jun. 3, 1997

[54] TRAVEL ROUTE INFORMATION MONITOR

[75] Inventors: Thanh K. Tran, Burtonsville; Barry A. Grasso, Sykesville, both of Md.

[73] Assignee: Loral Aerospace Corp., New York, N.Y.

[21] Appl. No.: 622,889

[22] Filed: Mar. 29, 1996

[51] Int. Cl.[6] ..... G08G 1/09

[52] U.S. Cl. ..... 340/905; 364/444.1; 364/423.098

[58] Field of Search ..... 340/905; 364/436, 364/437, 438, 424.01, 443, 444

[56] References Cited

U.S. PATENT DOCUMENTS

| | | | |
|---|---|---|---|
| 4,862,513 | 8/1989 | Bragas | 455/45 |
| 4,881,273 | 11/1989 | Koyama et al. | 455/161 |
| 5,020,143 | 5/1991 | Duckeck et al. | 455/186 |
| 5,065,452 | 11/1991 | Duckeck et al. | 455/226 |
| 5,095,532 | 3/1992 | Mardus | 455/186 |
| 5,107,433 | 4/1992 | Helldorfer et al. | 364/444 |
| 5,128,669 | 7/1992 | Dadds et al. | 340/905 |
| 5,146,219 | 9/1992 | Zechnall | 340/905 |
| 5,164,904 | 11/1992 | Sumner | 364/436 |
| 5,173,691 | 12/1992 | Sumner | 340/905 |
| 5,181,208 | 1/1993 | Duckeck | 371/40.1 |
| 5,193,214 | 3/1993 | Mardus et al. | 455/54.2 |
| 5,206,641 | 4/1993 | Grant et al. | 340/905 |
| 5,222,254 | 6/1993 | Verron et al. | 455/186.1 |
| 5,278,560 | 1/1994 | Hegeler et al. | 341/155 |
| 5,285,391 | 2/1994 | Smith, Jr. et al. | 364/443 |
| 5,289,184 | 2/1994 | Suzuki | 340/905 |
| 5,293,163 | 3/1994 | Kakihara et al. | 340/905 |
| 5,303,401 | 4/1994 | Duckeck et al. | 455/186.1 |
| 5,313,200 | 5/1994 | Sone | 340/905 |
| 5,317,311 | 5/1994 | Martell et al. | 340/905 |
| 5,345,607 | 9/1994 | Liman et al. | 455/186.1 |
| 5,353,034 | 10/1994 | Sato et al. | 342/457 |
| 5,406,490 | 4/1995 | Braegas | 340/905 |
| 5,438,687 | 8/1995 | Suchowerskyj et al. | 340/905 |
| 5,465,088 | 11/1995 | Braegas | 340/905 |
| 5,515,053 | 5/1996 | Hecht et al. | 340/905 |
| 5,523,950 | 6/1996 | Peterson | 340/905 |

*Primary Examiner*—Jeffery Hofsass
*Assistant Examiner*—Mohammed R. Ghannam
*Attorney, Agent, or Firm*—Perman & Green

[57] ABSTRACT

This invention pertains to: a method for controlling the monitoring of broadcast messages of traffic information, and reporting to a user, traffic information that relates to a set of user-specified routes of travel; and also to a travel route information monitor that operates in accordance with the method. The method includes a first step of programming information into a controller (1). A first portion of the programmed information specifies a time. A second portion of the programmed information specifies a set of geographical routes of travel comprising a primary route and at least one alternative route. A next step includes initiating the receiving of broadcast messages of traffic information at a time that is a function of the time specified by the first portion of the programmed information. A next step includes screening received broadcast messages to collect traffic information that relates to any of the routes of travel specified by the second portion of the programmed information. A next step includes reporting the collected traffic information to a user.

46 Claims, 3 Drawing Sheets

TRAVEL ROUTE INFORMATION MONITOR

FIELD OF THE INVENTION

This invention relates generally to travel information monitors and, in particular, to a travel route information monitoring system.

BACKGROUND OF THE INVENTION

U.S. Pat. No. 5,164,904 ('904) and 5,173,691 ('691) issued to Sumner disclose an In-Vehicle Traffic Congestion System which provides real time traffic congestion data to drivers. The system includes an apparatus for gathering and formatting traffic data at a central location, transmitting the data to vehicles, processing the data, and displaying data to a driver. The '691 patent discloses a "data fusion" process for collecting the traffic data.

U.S. Pat. No. 5,206,641 issued to Grant et al. discloses a portable electronic device which receives and stores digitally coded traffic reports for a geographical coverage area. Upon request, the device presents traffic information relevant to a user-specified vehicle trip within the coverage area. Traffic reports are collected at a traffic operations center and are encoded and broadcast to the units in the geographical coverage area using radio frequency transmission. A touch-sensitive map is used to indicate the trip's origin, destination, and routings of interest. The device makes calculations to select and modify the relevant reports and the traffic information from the selected reports presented to users by synthesized or digitized voice and sounds. In addition to presenting the information on demand, the device automatically announces new traffic reports received by the device which are relevant to the user-specified trip.

Neither the Sumner or Grant et al. patents, or any other prior art of which the inventors are aware, disclose a means for selectively controlling a traffic information monitor system based upon a time that is input by the user or calculated from a programmed departure time.

OBJECTS OF THE INVENTION

It is an object of this invention to provide a travel route information monitor that monitors broadcast traffic information based upon a time that is specified by the user, and that provides to a user portions of the broadcast traffic information relating to user-specified routes.

Further objects and advantages of this invention will become apparent from a consideration of the drawings and ensuing description.

SUMMARY OF THE INVENTION

The foregoing and other problems are overcome and the objects of the invention are realized by a method for controlling the monitoring of broadcast messages of traffic information based upon a time that is specified by a user, and reporting to a user traffic information that relates to user-specified geographical routes of travel. The method includes a first step of programming information into a controller. A first portion of the programmed information specifies a time. A second portion of the programmed information specifies at least one of a primary geographical route of travel and at least one alternative geographical route of travel. The primary geographical route represents a user-preferred geographical route of travel to be traversed during a trip of interest. The at least one alternative geographical route represents at least one geographical travel route that may be traversed in alternative to the primary route. Such alternative routes may be traversed in such cases wherein, for example it is decided to not traverse the primary route due to traffic delays occurring on the primary route. A next step includes enabling a receiver for receiving broadcast messages of traffic information from a transmitter at a time that is a function of the time specified by the first portion of the programmed information. A next step includes screening received broadcast messages to collect traffic information that relates to the geographical routes of travel specified by the second portion of the programmed information. A next step includes reporting the collected traffic information to a user.

In a preferred embodiment of the invention the first portion of the programmed information specifies a time of departure, and the step of initiating is performed by initiating the receiving of broadcast messages from a transmitter at a time that is a function of the time of departure specified by the first portion of the programmed information.

In accordance with an aspect of this invention, the first portion of the programmed information specifies a time of departure. The step of initiating is performed by initiating the receiving of broadcast messages from a transmitter at a time that occurs earlier than the time of departure specified by the first portion of the programmed information.

Further in accordance with the method of this invention, the step of initiating is performed at a time that occurs earlier than the time specified by the first portion of the programmed information, by an amount of time that is predetermined by the controller.

Further in accordance with the method of this invention, the step of initiating is performed at a time that occurs earlier than the time specified by the first portion of the programmed information, by an amount of time that is specified by a third portion of the programmed information.

The method further includes a step of programming information into the controller specifying that the collected traffic information be reported to a user. The step of reporting is performed in response to the programmed information.

The method may be employed in, by example, an in-vehicle traffic information system. In this case, the step of reporting is performed in response to starting the vehicle. Also in this case, the step of screening further includes the step of screening the received broadcast messages to collect traffic information that relates to portions of the at least one geographical route of travel specified by the second portion of the programmed information that have not already been traversed by the vehicle. Also in this case, the traffic information system is operating in a first operating mode. The traffic information system automatically begins operating in a second operating mode upon a completion of the step of reporting. Still in this case, the method further includes the steps of turning off the vehicle, and in response to the turning off of the vehicle, terminating the receiving of broadcast messages.

The method may be employed in, by example, a portable traffic information system. In this case, the traffic information system is operating in a first operating mode, the method further includes the steps of programming information into the controller. At least a portion of the programmed information specifies that the portable traffic information system operate in a second operating mode. In response to the at least a portion of the programmed information, the mode in which the traffic information system is operating is changed from the first operating mode to the second operating mode. Also in this case, the step of changing is performed after a time interval having a length that is predetermined by the controller. Also in this case, the step of changing is performed after a time interval having a length that is specified by at least another portion of the programmed information. Still in this case, the method further includes the step of generating a user-perceptible alerting indication upon a completion of the step of reporting, wherein the user-perceptible alerting indication is at least one of an audio indication and a visual indication.

Further in accordance with the method of this invention, the second portion of the programmed information specifies at least one geographical route of travel that corresponds to information stored within a map data base.

The method further includes the steps of programming information into the controller specifying that route guidance instructions associated with particular geographical routes be reported to the user. In response to this programmed information, information is reported to a user in accordance with the programmed information.

The method further includes the steps of determining an amount of at least one of time and distance to a geographical route that is related to the collected information. Thereafter, the determined amount, of at least one of time and distance is reported to a user.

A third portion of the programmed information may specify that the receiving of broadcast messages be terminated. In this case, the method further includes the step of terminating the receiving of broadcast messages in response to the third portion of the programmed information.

The third portion of the programmed information may specify a time. In this case, the method further includes the step of terminating the receiving of broadcast messages at a time that is a function of the time specified by the third portion of the programmed information.

The method further includes the step of terminating the receiving of broadcast messages at a time that occurs later than the time specified by the first portion of the programmed information, by an amount of time that is specified by a third portion of the programmed information.

Further in accordance with the method of this invention, the second portion of the programmed information specifies a plurality of geographical routes of travel. The step of screening is also performed to collect traffic information that relates to geographical routes that connect at least portions of at least one of the plurality of geographical routes of travel specified by the second portion of the programmed information. The plurality of geographical routes of travel comprise at least one of a primary geographical route and at least one alternative geographical route.

The Step of reporting can be performed to report to a user collected traffic information that relates to a default route, wherein the default route is at least one of the primary geographical route and the at least one alternative geographical route.

The step of screening may also be performed to collect traffic information that relates to geographical routes that connect at least parts of the portions of the at least one geographical route of travel specified by the second portion of the programmed information that have not been already traversed by the vehicle.

BRIEF DESCRIPTION OF THE DRAWINGS

The above set forth and other features of the invention are made more apparent in the ensuing Detailed Description of the Invention when read in conjunction with the attached Drawing, wherein.

DETAILED DESCRIPTION OF THE INVENTION

The ensuing description describes the invention for use in a vehicular traffic application. It should be Understood, however, that the invention is not intended to be so limiting, and may be employed in other applications.

Figure 1:
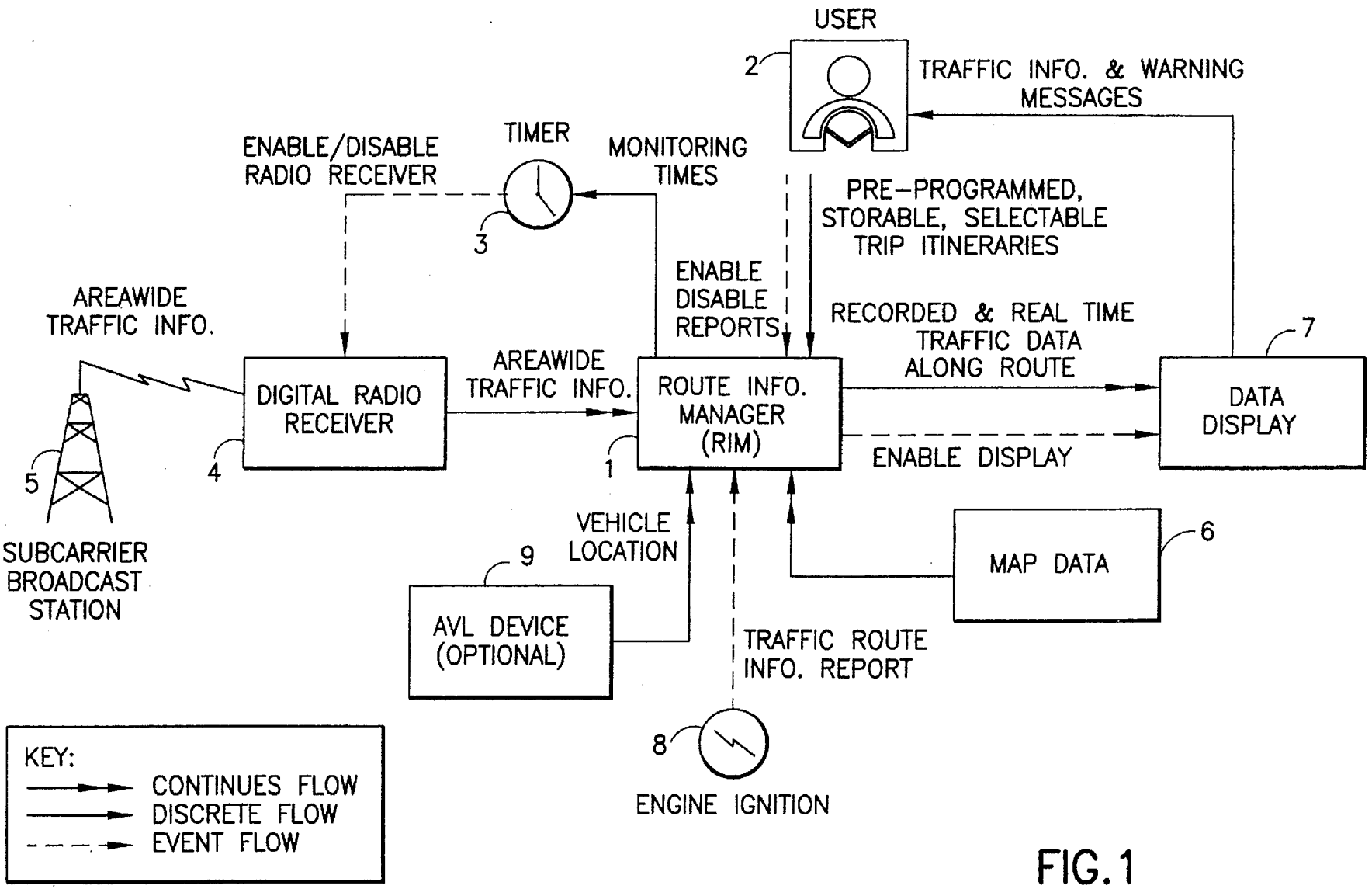
FIG. 1 is a block diagram of the elements of a travel route information monitor that is constructed and operated in accordance with this invention.

FIG. 1 illustrates a block diagram of a travel route information monitor (hereinafter referred to as a "TRIM") that is constructed in accordance with this invention. The TRIM comprises a digital radio receiver (hereinafter referred to as a "DRR") 4, a data display monitor 7, a timer 3, a map data base 6, an automated vehicle location device (hereinafter referred to as an "AVL") 9, and a route information manager (hereinafter referred to as a "RIM") 1. The RIM 1 comprises at least one microprocessor. In a preferred, embodiment of the invention, the DRR 4 is a subcarrier radio digital broadcast receiver that is capable of receiving either AM or FM subcarrier broadcast signals (e.g., FM Subsidiary Communications Authorization (SCA) for Traffic Information Channel or AM Digital Audio Broadcast). The TRIM may be embodied as a portable device or may be mounted within a vehicle.

Figures 2, 2A, 2B:
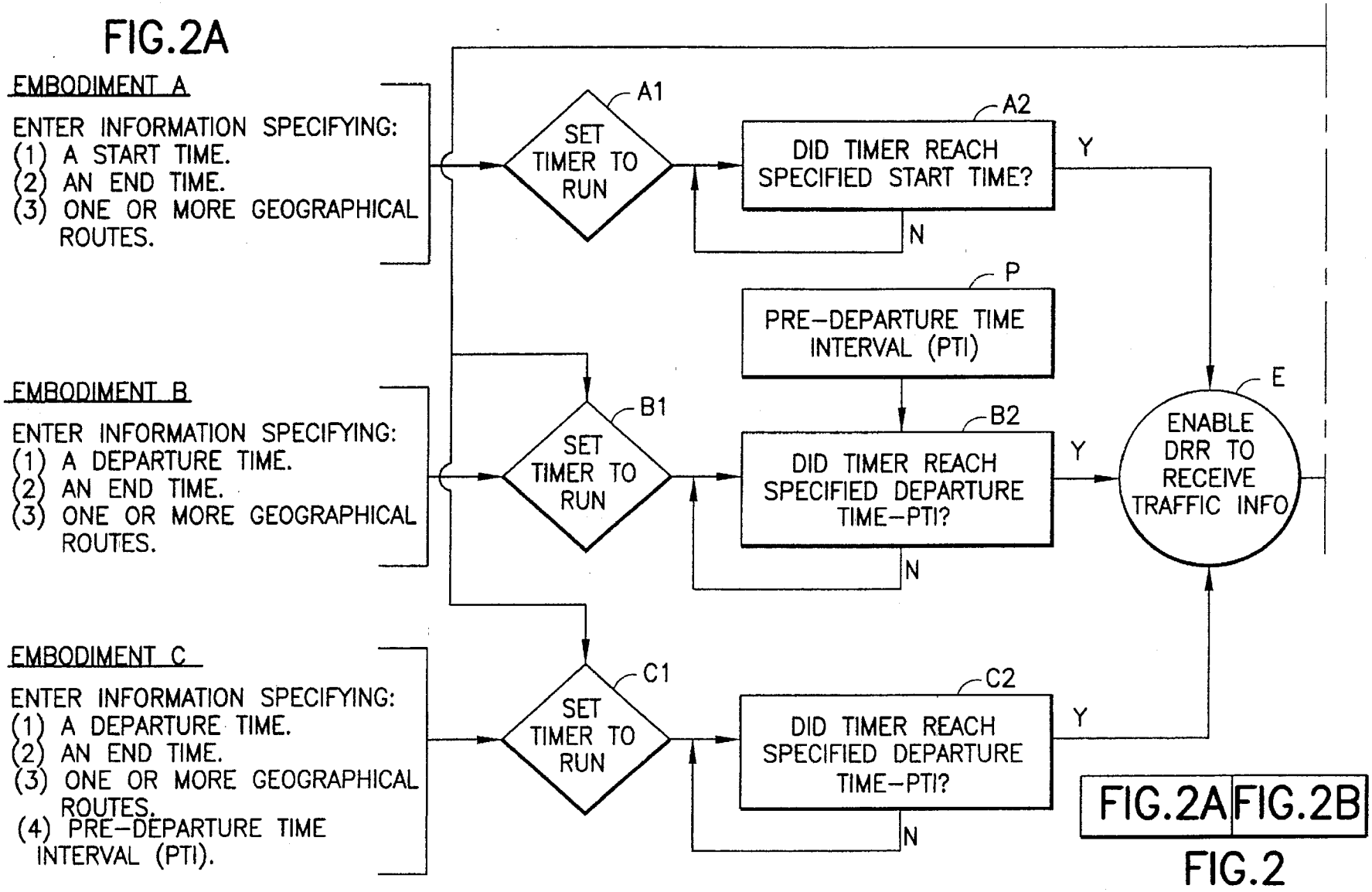
FIG. 2 illustrates the relationship of FIG. 2A to FIG. 2B.
FIGS. 2A and 2B are a logical flow diagram of a method in accordance with this invention.
Figure 2B:
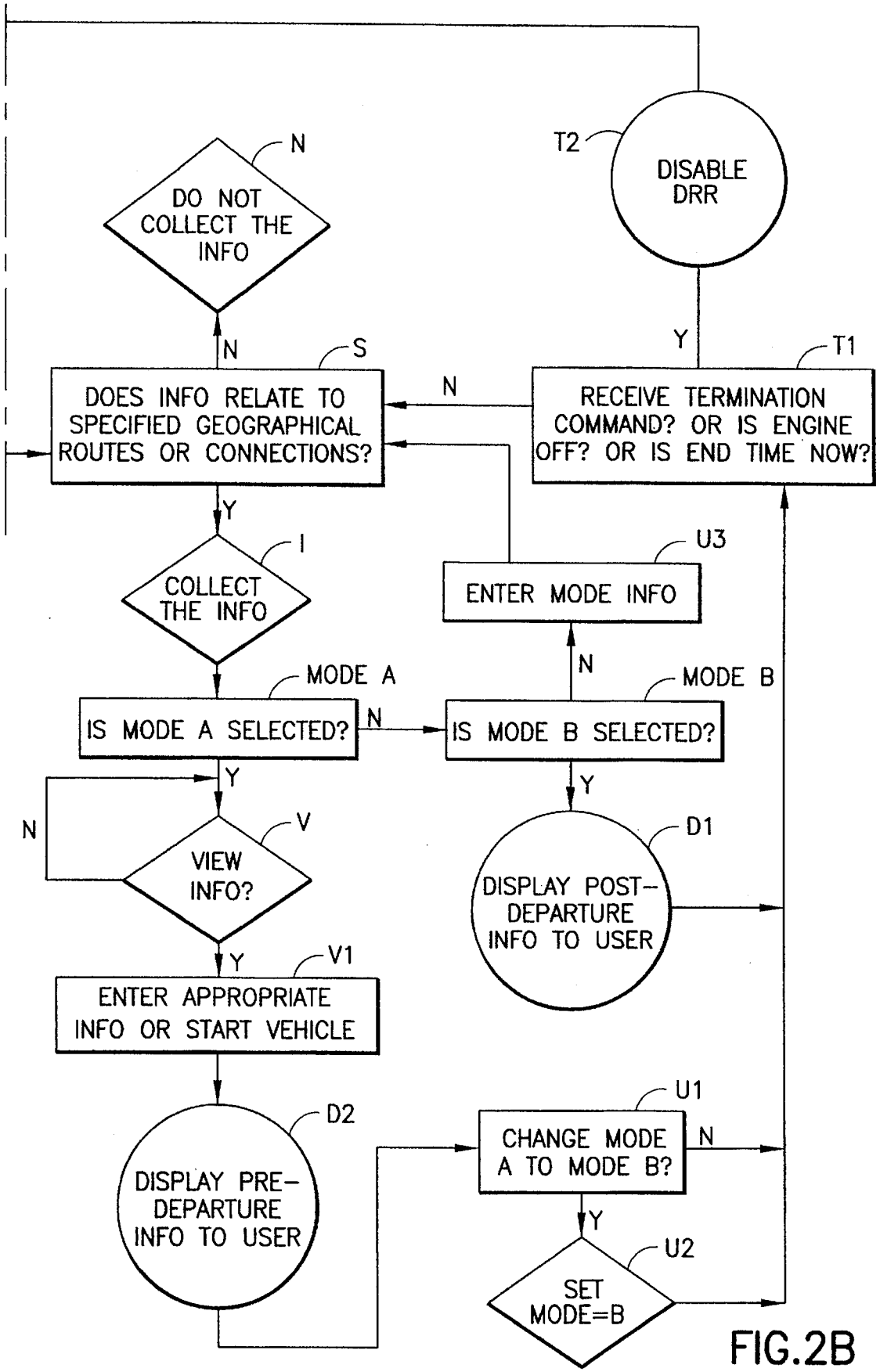

In a preferred embodiment of the invention, a base station 5 broadcasts digital signals representing wide area traffic information. The TRIM receives the broadcast traffic information based upon a time specified by the user 2. The TRIM then monitors the received broadcast traffic information to collect information that is relevant to user-specified geographical routes and their connecting geographical routes. Thereafter, the TRIM notifies the user 2 of the collected information in a manner that is based upon a user-specified operating mode. The TRIM is implemented in various embodiments, as will be described below. Referring to FIG. 2, these embodiments are denoted as EMBODIMENT A, EMBODIMENT B, and EMBODIMENT C.

It is assumed that in order to provide efficient communications, the traffic information is only broadcast by the base station 5 on an exception basis; that is, the traffic information associated with a particular geographical route (such information is also referred to below as a "link") is broadcast only when certain traffic flow parameters associated with the link exceed predetermined threshold value (i.e., which may represent that the geographical route related to that link is, for example, congested with traffic). However, it should be understood that the particular details of the base station 5 itself are not considered to be of particular concern to this invention.

In one embodiment (EMBODIMENT A) of the invention, and referring now also to FIG. 2, the TRIM operates in the following manner. A user 2, who is planning to begin travelling in a vehicle (not illustrated) at a particular departure time via a predetermined geographical route programs information into the RIM 1 via a user interface, such as keypad (not illustrated). The information specifies: (1) the time at which the user 2 desires the TRIM to begin monitoring broadcast traffic information, and (2) at least one of a primary geographical route of travel and at least one alternative geographical route of travel, pertaining to a periodic (e.g., daily weekly) trip itinerary. By example, the primary geographical route represents a geographical travel route the user 2 prefers to traverse pertaining to the trip itinerary. Also by example, the at least one alternative geographical route represents: (1) a first alternative geographical travel route the user 2 prefers to traverse in,the case wherein the user 2 decides to not traverse the primary geographical route (owing to, by example, traffic congestion occurring on the primary route); and (2) a second alternative geographical travel route the user 2 prefers to traverse in the case in which the user 2 decides to not traverse the primary route or the first alternative route (owing to, by example, traffic congestion occurring on the primary and first alternative routes). In an exemplary embodiment of the invention, the information for each of the respective primary and alternative routes may be programmed into the RIM 1 in response to a corresponding prompt by the TRIM. In another embodiment of the invention, which will be discussed below, the information the user 2 programs into the RIM 1 also specifies a time at which the user 2 desires the TRIM to terminate the monitoring of broadcast traffic information.

Upon receiving the programmed information, the RIM 1 sets the timer 3 to run (Block A1). When the timer 3 reaches the time specified by the user 2 (Block A2), the timer 3 sends a signal to enable the DRR 4 to begin receiving signals being transmitted from the broadcast base station 5. The enabling of the DRR 4 is denoted in FIG. 2 as Block E. Thereafter, the TRIM monitors the received signals for pertinent traffic information, in a manner as Will be described below. It should be noted that the time specified by the user 2 may be any time that the user 2 wishes the TRIM to begin monitoring the broadcast traffic information including, for example, the departure time or a time that is earlier than the departure time. For the latter example, the TRIM begins to compile pertinent traffic information at an earlier time than the departure time, thereby enabling the user 2 to be notified of possible traffic problems occurring on the user's primary and alternative geographical routes of travel and their connecting geographical routes prior to the departure time of the trip. It should be noted that the manner in which the TRIM compiles and notifies the user 2 of pertinent traffic information will be discussed below.

In accordance with the invention, and for a vehicle-mounted TRIM embodiment, the vehicle need not be running for the TRIM to activate the DRR 4 and begin receiving and compiling route-related information.

In another embodiment (EMBODIMENT B) of this invention, the TRIM assumes that the time programmed into the RIM 1 by the user 2 specifies a time of departure. Based upon the programmed time, the TRIM begins monitoring the broadcast traffic information at a time that occurs earlier than the programmed time. In a manner that is similar to the example of the embodiment discussed above, the TRIM compiles relevant information at an earlier time than the specified departure time, thereby enabling the user 2 to be notified of possible traffic problems occurring on the user's primary, alternative, and connecting geographical routes of travel prior to the time of departure. To implement this embodiment, the user 2 programs into the RIM 1 information (as part of the travel itinerary) which specifies the time at which the user 2 anticipates to depart in the vehicle. Thereafter, the. RIM 1 sets the timer 3 to enable the DRR 4 at an earlier time (e.g., 30 minutes earlier) than that specified by the user 2. The amount of time by which the earlier time precedes the user-specified departure time is deemed to be, for the purposes of this description, a "pre-departure time interval". In this embodiment (EMBODIMENT B) of the invention, the length of the pre-departure time interval (Block P) is predetermined by the RIM 1. As such, the RIM 1 sets the timer 3 to run (Block B1) and automatically enable the DRR 4 (Block E) at the earlier time. The determination of the occurrence of the earlier time is denoted as Block B2.

In another embodiment (EMBODIMENT C) of this invention, the length of the pre-departure time interval is specified by the user 2. To implement this embodiment, the user 2 programs appropriate information into the RIM 1 specifying the length of the pre-departure time interval (i.e., the amount of time prior to the departure time that the user 2 desires the TRIM Go begin monitoring the broadcast information). Thereafter, the RIM 1 sets the timer 3 to run (Block C1) and enable the DRR 4 (Block E) at the earlier time based upon the specified pre-departure time interval information. In this embodiment, the determination of the occurrence of the earlier time is denoted in FIG. 2 as Block C2.

The information the user 2 programs into the RIM 1 specifying the predetermined geographical routes (i.e., the primary geographical route and the first and second alternative geographical routes) is stored in the RIM 1 as a user-specified link attribute and corresponds to identifiable links of information of a known type of road network link identification layer (RNLIL) that is stored within the map data base 6. The RNLIL information represents a standardized "map" which includes identifiable links of information. As stated previously, each link corresponds to a particular geographical route. In this manner, when a user 2 enters information into the RIM 1 specifying a particular geographical route, the RIM 1 identifies links of the RNLIL information stored within the map data base 6 that correspond to the route.

In addition, the RIM 1 identifies links of the RNLIL information that correspond to geographical routes, if any, which connect the user-specified geographical routes. By example, the RIM 1 identifies links that correspond to: (1) geographical routes which connect the primary geographical route to the first alternative route; (2) geographical routes which connect the primary geographical route to the second alternative route; and (3) geographical routes which connect the first alternative route to the second alternative route.

In the preferred embodiment of this invention, the traffic information that is broadcast from the base station 5 represents links of information which relate to the same standardized RNLIL as do the specified geographical routes. Thus, links of the broadcast traffic information correspond to links of information stored within the RNLIL; that is, links of broadcast traffic information and corresponding links of RNLIL information represent the same geographical routes.

Once the DRR 4 begins receiving traffic information from the broadcast base station 5, the information is forwarded to the RIM 1. The RIM 1 thereafter compares the received links of traffic information to the links if the RNLIL information that have been identified by the RIM 1 based upon the user-specified geographical route. Those received links which correspond to the identified links are screened and recorded by the RIM 12. These two steps are denoted in FIG. 2 as Block S and Block I, respectively. The recorded information remains stored in the RIM 1 until either: (1) the user 2 enters appropriate information into the RIM 1 specifying that the recorded information be erased, whereafter the RIM 1 erases the recorded information, or (2) the recorded information is overwritten in memory by subsequently received traffic information. For the purposes of this description, the recorded information is also referred to below as "relevant information" or "screened information".

Those received links which do not correspond to the identified links are not recorded by the RIM 1 (Block N). In this manner, the TRIM will notify the user 2 of traffic information which relates to the geographical routes specified by the information programmed into the RIM 1, and of traffic information which relates to the geographical routes which connect the specified geographical routes, only.

The TRIM can operate in one of at least two modes, depending upon the manner in which the user 2 desires to be notified of the traffic information recorded by the RIM 1. For either operating mode, a reporting device (e.g., a visual display device or an audio device) is employed which is capable of relating the information of the screened links to the user 2. In the preferred embodiment, the reporting device is the data display 7.

The first operating mode, deemed to be a "pre-trip monitoring mode" and denoted in FIG. 2 as mode A, permits the user 2 to select when he desires the TRIM to notify him of the recorded information. The first operating mode can be selected by the user 2 programming appropriate information into the RIM 1 specifying that the first operating mode is to be selected (this step is not illustrated). Once this operating mode has been selected, the user 2 may specify when he desires to View the traffic information via the data display 7. This may be done by implementing either one of two options, both of which are denoted singularly, for purposes of clarity, as Block V in FIG. 2.

For the first option, the user 2 can program information into the RIM 1 which specifies that the recorded information be reported to the user 2. This step is denoted as Block V1 in FIG. 2. The implementation of this option is useful in cases in which, for example, the user 2 desires to be notified of the most recently received traffic information prior to embarking on a trip in the vehicle. Upon receiving the programmed information, the RIM 1 enables the data display 7 to display the recorded information (Block D2), thereby notifying the user 2 of recorded traffic information (e.g., traffic congestion) that is relevant to the particular geographical routes the user 2 specified into the RIM 1. The information is displayed by the data display 7 for a time period (e.g. 3 minutes) that is predetermined by the RIM 1. For the case in which the information is reported to the user 2 by an audio device, the information is reported by the audio device for as long as it takes to complete a synthesized voice report of the information.

It should be noted that in one embodiment (not illustrated) of the invention, the pre-trip monitoring mode may be the default mode of the TRIM. In this case, the user 2 does not need to program the TRIM in order to select this operating mode.

To implement the second option, the user 2 can simply turn on the automobile ignition 8 (this step is also denoted in FIG. 2 as Block V1). Thereafter, a signal indicating such is sent to the RIM 1. Upon receiving the signal, the RIM 1 enables the data display 7 (Block D2) in the same manner as described above.

The second operating mode, deemed to be an "en-route monitoring mode" and denoted in FIG. 2 as Mode B, enables the user 2 to be notified of relevant received traffic information on a real-time basis. In this manner, the user 2 is notified of relevant traffic information as it is being received by the TRIM. For the case in which the TRIM is embodied as an in-vehicle device, the second operating mode is automatically implemented upon the completion of the reporting of the recorded information to the user 2, via the reporting device (e.g., one of the data display 7 and the audio device). For this case, once the reporting of the recorded information is completed, such is identified by the RIM 1. The RIM 1 thereafter invokes the second operating mode.

For the case in which the TRIM is embodied as a portable device, the second operating mode is implemented via the user 2 operating a switch (not illustrated) or programming into the RIM 1 appropriate information which specifies that the TRIM operate in the en-route monitoring mode (Block U3). The user 2 of such a portable TRIM may desire to implement the second operating mode as such in cases wherein, for example, the user 2 is about to take the TRIM into a vehicle to embark on a trip. An alerting indicator such as, for example, an audible tone, or a flashing light, may be employed in the portable TRIM to notify the user 2 that the reporting of the recorded information has been completed. In this manner, when the user 2 is alerted as such via the alerting indicator, the user 2 can decide whether it is the appropriate time to implement the second operating mode. Thereafter, the user 2 may program information into the RIM 1 specifying that the TRIM operate in the en route monitoring mode, in a manner as described above, at a desired time. In one embodiment of the invention, the user 2 may respond to the alerting indicator by entering into the RIM 1 appropriate information specifying that the TRIM remain in the first operating mode for a time period that is predetermined by the RIM 1. In another embodiment of the invention, the user 2 can specify the length of the time period by entering appropriate information into the RIM 1. For either embodiment, the RIM 1 sets the timer 3 to run in response to the user-specified information and the TRIM operates in the first operating mode until the timer 3 reaches the end of the time period. When the timer 3 reaches the end of the time period, the RIM 1 causes the TRIM to begin operating in the second operating mode.

Once the TRIM is operating in the second operating mode, and assuming that the DRR 4 is already enabled (i.e., by the user 2 previously selecting the first operating mode before the second operating mode was selected), the RIM 1 screens the signals received by the DRR 4 for relevant traffic information in the same manner as described above. As such, once the information is screened, it is recorded and forwarded by the RIM 1 to the data display 7, which then displays the relevant information to the user 2 (Block D1). For the case in which the user 2 programs information into the RIM 1 causing the selection of the en-route operating mode during a time when the DRR 4 is not already enabled, the RIM 1 sets the timer 3 in response to the programmed information such that the timer 3 immediately enables the DRR 4. Thereafter the DRR 4 receives the broadcast signals and forwards them to the RIM 1. The RIM 1 then screens the signals for relevant information, records the relevant information, and provides the information to the data display 7 in the same manner as described above.

The user 2 can program into the RIM 1 information specifying geographical routes of travel (e.g. a primary geographical route, and first and second alternative geographical routes) while the TRIM is operating in the enroute operating mode. In a preferred embodiment of the invention, the TRIM reports via the reporting device (e.g., the data display 7) received traffic information that pertains to a default route only. In the preferred embodiment of the invention, the default route is the primary geographical route. As such, although traffic information pertaining to the user-specified routes of travel specified by the second portion of the programmed information is monitored and recorded by the RIM 1, only traffic information which pertains-to the default route is reported. In a case in which, by example, one of the first and second alternative geographical routes is being traversed during a trip, the user 2 may program information into the RIM 1 specifying that the route being traversed is now the default route. As such, the user 2 is notified of traffic information relating to this new default route only. The alternative geographical route remains the default route until the user 2 reprograms the RIM 1 to change the default route. As another option, the user 2 may program the RIM 1 such that the primary geographical route and the alternative geographical route being traversed are both default routes. As such, the user 2 is notified of traffic information relating to both of these routes. This option may be useful to a user 2 who is traversing the alternative geographical route as a detour in order to, by example, bypass traffic congestion occuring on the primary geographical route. The traffic information would help the user 2, who wishes to return to the primary route, to determine when to do so in order to avoid the congestion. As another option, the user 2 may enter appropriate information into the RIM 1 specifying that the TRIM report received traffic information pertaining to any of the user-specified routes and their connecting routes. Thereafter, the TRIM monitors and reports information pertaining to all user-specified routes and their connecting routes. This mode of operation is deemed to be a "network mode".

In one embodiment of this invention, the TRIM may be employed with an automated vehicle location device (hereinafter referred to as an "AVL") 9. The AVL comprises a number of embodiments (not illustrated), each of which may be employed in one application of the AVL 9. In one embodiment of the AVL 9, the AVL 9 enables the TRIM to "filter" out traffic information that relates to geographical routes that have already been traversed by the vehicle during a trip, and any routes which Connect such traversed routes. In this embodiment, the AVL 9 is a device which uses a technique (e.g., dead reckoning, GPS, etc.) to monitor the vehicle's velocity, heading and distance travelled, or the vehicle's location in latitude and longitude, to determine geographical routes that have already been travelled by the vehicle. When these routes have been determined, information representing these routes is provided by the AVL 9 to the RIM 1, wherein it is recorded, and wherein geographical routes that connect the determined routes are determined. Thereafter, when the RIM 1 screens information received from the DRR 4, portions of the information that relate to the information received from the AVL 9, or to the determined connecting routes, are not recorded by the RIM 1 and forwarded to the data display 7. In this regard, the user 2 is not notified of traffic information that relates to the geographical routes that have been already travelled by the vehicle during the particular trip of interest, or of traffic information that relates to routes which connect such travelled routes.

In another embodiment of the AVL 9, the AVL 9 provides estimates of the time and/or distance to a traffic condition that is upcoming on a geographical route that is yet to be travelled by the vehicle during the trip of interest. These estimates may be helpful to the user 2 in cases in which, for example, he has been notified of an upcoming traffic condition (e.g., congestion) by the TRIM and is considering whether it would be advantageous to detour from the intended geographical route of his trip itinerary. This embodiment of the AVL 9 may employ a similar technique (e.g., dead reckoning, GPS, etc.) as that described above, except that in this embodiment the vehicle's velocity, heading and distance travelled are monitored to determine time and/or distance to the upcoming traffic condition. Once the time and/or distance to the upcoming traffic condition is determined, information representing the time and/or distance is provided by the AVL 9 to the RIM 1 which, in turn, provides the information to the data display 7. The information is thereafter displayed to the user 2.

In still another embodiment of the AVL 9, the AVL 9 can be used to provide route guidance instructions to the user 2 based upon geographical route information stored within the map data base 6. This embodiment may be helpful to the user 2 in cases in which, for example, it is necessary for the user 2 to travel in the vehicle via unfamiliar, alternate geographical routes.

The DRR 4 can be disabled via various options and embodiments for each of the following cases, respectively, wherein: (1) the TRIM is embodied as a vehicle-mounted device, and (2) the TRIM is embodied as a portable device. For the former case, the DRR 4 can be disabled by the user 2 performing either one of two options. For the first option, the user 2 can enter appropriate information into the RIM 1 specifying that the DRR 4 be disabled. In response to the entered information the RIM 1 then sets the timer 3 to immediately disable the DRR 4. These steps are devoted in FIG. 2 as Block T1 and Block T2, respectively. For the second option, the user 2 can disable the DRR 4 by turning off the automobile ignition 8, whereafter such is communicated to the RIM 1 which then sets the timer 3 to immediately disable to DRR 4. These steps are also denoted in FIG. 2 as Block T1 and Block T2.

For the case where the TRIM is embodied as a portable device, the DRR 4 can be disabled via one of three embodiments. The first embodiment is performed in a manner similar to that described above for the first option of the case in which the TRIM is embodied as a, vehicle-mounted device. The second embodiment permits the user 2 to specify at which time it is desired to terminate the receiving of broadcast messages. To implement this embodiment, the user 2 programs information into the TRIM 1 specifying a time at which it is desired to terminate the receiving of broadcast messages. Such information is designated in FIG. 2 as an "end time". The RIM 1 thereafter sets the timer 3 to run and disable the DRR 4 at the time specified by the programmed information. The third embodiment is performed automatically by the RIM 1 setting the timer 3 to disable the DRR 4 at a time that occurs later than the time at which the DRR 4 was enabled by an amount of time (e.g., 2 hours) specified by the user 2. The user 2 specifies this amount of time while initially programming information into the RIM 1 relating to the travel itinerary.

While the invention has been particularly shown and described with respect to preferred embodiments thereof, it will be understood by those skilled in the art that changes in form and details may be made therein without departing from the scope and spirit of the invention.

What is claimed is:

1. A method for controlling the monitoring of broadcast messages of traffic information, and reporting to a user traffic information that relates to at least one user-specified route of travel, comprising the steps of:

programming information into a controller, a first selectable portion of the programmed information specifying a selectable time, a second portion of the programmed information specifying at least one geographical route of travel;

initiating the receiving of broadcast messages of traffic information at the time specified by the first portion of the programmed information;

screening received broadcast messages to collect traffic information that relates to the at least one geographical route of travel specified by the second portion of the programmed information; and reporting the collected traffic information to a user.

2. A method as set forth in claim 1, wherein the first portion of the programmed information specifies an intended time of departure, and wherein the step of initiating includes the step of:

initiating the receiving of broadcast messages at the time of departure specified by the first portion of the programmed information.

3. A method as set forth in claim 1, wherein the first portion of the programmed information specifies a time of departure, and wherein the step of initiating includes the step of:

initiating the receiving of broadcast messages at a time that occurs earlier than the time of departure specified by the first portion of the programmed information.

4. A method as set forth in claim 3, wherein the step of initiating is performed at a time that occurs earlier than the time specified by the first portion of the programmed information, by an amount of time that is predetermined by the controller.

5. A method as set forth in claim 3, wherein the step of initiating is performed at a time that occurs earlier than the time specified by the first portion of the programmed information, by an amount of time that is specified by a third portion of the programmed information.

6. A method as set forth in claim 1, further comprising the step of:

programming information into the controller specifying that the collected traffic information be reported to a user, and wherein the step of reporting is performed in response to the programmed information.

7. A method as set forth in claim 6, being employed in an in-vehicle traffic information system operating in a first operating mode, wherein upon a completion of the step of reporting, the traffic information system automatically begins operating in a second operating mode.

8. A method as set forth in claim 1, being employed in a portable traffic information system.

9. A method as set forth in claim 8, wherein the portable traffic information system is operating in a first operating mode, further comprising the steps of:

programming information into the controller, at least a portion of the programmed information specifying that the portable traffic information system operate in a second operating mode; and in response to the at least a portion of the programmed information, changing the operation of the portable traffic information system from the first operating mode to a second operating mode.

10. A method as set forth in claim 9, wherein the step of changing is performed after a time interval having a length that is predetermined by the controller.

11. A method as set forth in claim 9, wherein the step of changing is performed after a time interval having a length that is specified by at least another portion of the programmed information.

12. A method as set forth in claim 8, further comprising the step of:

generating a user-perceptible alerting indication upon a completion of the step of reporting.

13. A method as set forth in claim 12, wherein the user-perceptible alerting indication is at least one of an audio indication and a visual indication.

14. A method as set forth in claim 1, being employed in an in-vehicle traffic information system.

15. A method as set forth in claim 14, wherein the step of reporting is performed in response to starting a vehicle within which the in-vehicle traffic information system is located.

16. A method as set forth in claim 14, wherein the step of screening includes the step of:

screening the received broadcast messages to collect traffic information that relates to portions of the at least one geographical route of travel specified by the second portion of the programmed information that have not been already traversed by the vehicle.

17. A method as set forth in claim 1, wherein the second portion of the programmed information specifies at least One geographical route of travel that corresponds to information stored within a map data base.

18. A method as set forth in claim 1, further including the steps of:

programming information into the controller specifying that route guidance instructions associated with particular geographical routes be reported to the user; and in response to the programmed information, reporting information to a user in accordance with the programmed information.

19. A method as set forth in claim 1, further comprising the steps of:

determining an amount of at least one of time and distance to a geographical route that is related to the collected traffic information; and reporting the determined amount of at least one of time and distance to a user.

20. A method as set forth in claim 1, Wherein a third portion of the programmed information specifies that the receiving of broadcast messages be terminated, further comprising the step of:

terminating the receiving of broadcast messages in response to the third portion of the programmed information.

21. A method as set forth in claim 1, wherein a third portion of the programmed information specifies a time, further comprising the step of:

terminating the receiving of broadcast messages at a time that is a function of the time specified by the third portion of the programmed information.

22. A method as set forth in claim 8, further comprising the step of:

terminating the receiving of broadcast messages at a time that occurs later than the time specified by the first portion of the programmed information, by an amount of time that is specified by a third portion of the programmed information.

23. A method as set forth in claim 14 further comprising the steps of:

turning off the vehicle within which the in-vehicle traffic information system is located; and.

in response to the turning off the vehicle, terminating the receiving of broadcast messages.

24. A method as set forth in claim 1, wherein the second portion of the programmed information specifies a plurality of geographical routes of travel, and wherein the step of screening is also performed to collect traffic information that relates to geographical routes that connect at least portions of at least one of the plurality of geographical routes of travel specified by the second portion of the programmed information.

25. A method as set forth in claim 24, wherein the plurality of geographical routes of travel comprise at least one of a primary geographical route and at least one alternative geographical route.

26. A method as set forth in claim 25, wherein he step of reporting is performed to report to a user collected traffic information that relates to a default route, wherein the default route is at least one of the primary geographical route and the at least one alternative geographical route.

27. A method as set forth in claim 16, wherein the step of screening is also performed to collect traffic information that relates to geographical routes that connect at least parts of the portions of the at least one geographical route of travel specified by the second portion of the programmed information that have not been already traversed by the vehicle.

28. A traffic information monitor, comprising:

timing means having an input, said timing means being set in response to information that is applied to said input, for providing an output signal at a time specified by said information;

a receiver, being enabled in response to an output signal from said timing means, for receiving broadcast signals, and for outputting said received signals;

a reporting device having an input, said reporting device for reporting information that is applied at said reporting device input to a user;

a user interface for receiving information from a user, a first portion of the received information specifying a time, a second portion of the received information specifying at least one geographical route of travel; and a controller having an input coupled an output of said user interface for receiving user information therefrom, said controller screening signals that are output by said receiver to collect traffic information that corresponds to said second portion of said user information, and for providing the collected traffic information to said reporting device input, said controller being responsive to said user information for providing said first portion of said user information to said timing means input.

29. A traffic information monitor as set forth in claim 28, wherein said controller has an associated predetermined time value, and is responsive to said first portion of said user information for providing timing information to said timing means input, which timing information specifies a time that occurs earlier than a time specified by said first portion of said user information, by an amount that is equal to said predetermined time value.

30. A traffic information monitor as set forth in claim 28, wherein a third portion of the user information specifies a time value, and wherein said controller is responsive to said user information for providing timing information to said timing means input, which timing information specifies a time that occurs earlier than the time specified by said first portion of said user information by an amount which is specified by said third portion of said user information.

31. A traffic information monitor as set forth in claim 28 that is an in-vehicle device.

32. A traffic information monitor as set forth in claim 28 that is portable.

33. A traffic information monitor as set forth in claim 28, further comprising:

a map data base, wherein information representing geographical routes is stored; and wherein said second portion of the user information specifies at least one geographical route of travel which corresponds to at least a portion of the information stored within said map data base.

34. A traffic information monitor as set forth in claim 28, wherein said controller provides the collected information to said reporting device input in response to receiving user information from said user interface, which user information specifies that collected information be reported to a user.

35. A traffic information monitor as set forth in claim 28, mounted in a vehicle, and further comprising:

an automated vehicle location device, said automated vehicle location device for determining a position of said vehicle, and for providing information representing the determined position to said controller, and wherein said controller is responsive to said position information for determining, based upon said position information, a distance between the vehicle and a geographical route that corresponds to said collected traffic information, and for providing information representing the determined distance to said reporting device.

36. A traffic information monitor as set forth in claim 35, wherein based upon said position information, said controller also determines an amount of time that will elapse before the vehicle reaches said geographical route, and wherein said controller provides information representing the determined amount of time to said reporting device.

37. A traffic information monitor as set forth in claim 35, wherein based upon said position information, said controller also determines which portions of the at least one geographical route of travel specified by said second portion of said user information have been already traversed by the vehicle during a trip of interest; and wherein said controller comprises means for screening signals that are output by said receiver to collect traffic information that corresponds to said second portion of said user information, but does not correspond to the portions of the at least one geographical route of travel determined to have been already traversed by the vehicle.

38. A traffic information monitor as set forth in claim 37, wherein said screening means also screens said signals that are output by said receiver to collect traffic information that corresponds to geographical routes that connect at least portions of the at least one geographical route of travel specified by said second portion of said user information, which portions of the at least one geographical route of travel do not correspond to the portions of the at least one geographical route of travel determined to have been already traversed by the vehicle.

39. A traffic information monitor as set forth in claim 28, wherein said reporting device is at least one of a visual display device and an audio device.

40. A traffic information monitor as set forth in claim 28, further comprising:

means for generating a user-perceptible alerting indication upon a completion of a reporting of information by said reporting device.

41. A traffic information monitor as set forth in claim 40, wherein said means for generating a user perceptible alerting indication comprises at least one of an audio device and an optical device.

42. A traffic information monitor as set forth in claim 28, wherein a third portion of the user information specifies that the receiver be disabled, wherein in response to said user information said controller provides said third portion of said user information to said timing means input, wherein said timing means is also for outputting a disabling signal, and wherein said receiver is disabled in response to a disabling signal output by said timing means.

43. A traffic information monitor as set forth in claim 28, said traffic information device being portable, wherein a third portion of said user information specifies a time, wherein in response to said user information said controller provides said third portion of said user information to said timing means input, wherein said timing means is set in response to said third portion of said user information for outputting a disabling signal at a time that is a function of the time specified by said third portion of said user information, and wherein said receiver is disabled in response to a disabling Signal that is output by said timing means.

44. A traffic information monitor as set forth in claim 43, wherein said third portion of said user information specifies a time interval, wherein said timing means is set in response to said first portion of said user information for outputting an enabling signal, said timing means also being set in response to said third portion of said user information for outputting a disabling signal at a time that occurs later than the time specified by said first portion of said user information, by an amount that is specified by said third portion of said user information, and wherein said receiver is enabled in response to an enabling signal that is output from said timing means.

45. A traffic information monitor as set forth in claim 28, wherein said controller is also for screening signals that are output by said receiver to collect traffic information that corresponds to at least one geographical route which connects at least portions of the at least one geographical route of travel specified by said second portion of said user information.

46. A traffic information monitor as set forth in claim 37, wherein based upon said position information, said controller also determines geographical routes of travel that connect at least portions of the at least one geographical route of travel specified by said second portion of said user information that have been already traversed by said vehicle during a trip of interest; and wherein said screening means screens signals that are output by said receiver to collect traffic information that corresponds to geographical routes of travel that connect at least portions of the at least one geographical route of travel specified by said second portion of said user information, but that does not correspond to said geographical routes of travel that connect at least portions of the at least one geographical route of travel determined to have been already traversed by the vehicle.

* * * * *